US009561663B2

(12) United States Patent
Katsuki

(10) Patent No.: US 9,561,663 B2
(45) Date of Patent: Feb. 7, 2017

(54) INK CARTRIDGE AND PRINTER

(71) Applicant: Seiko Epson Corporation, Tokyo (JP)

(72) Inventor: Kiyoteru Katsuki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/939,538

(22) Filed: Nov. 12, 2015

(65) Prior Publication Data

US 2016/0136961 A1 May 19, 2016

(30) Foreign Application Priority Data

Nov. 13, 2014 (JP) ..... 2014-230440
Jun. 1, 2015 (JP) ..... 2015-111141

(51) Int. Cl.

| | |
|---|---|
| ***B41J 2/175*** | (2006.01) |
| ***B41J 2/195*** | (2006.01) |
| ***B41J 2/17*** | (2006.01) |
| ***B41J 29/13*** | (2006.01) |

(52) U.S. Cl.
CPC ..... *B41J 2/17553* (2013.01); *B41J 2/17509* (2013.01); *B41J 29/13* (2013.01)

(58) Field of Classification Search
CPC ... B41J 2/17513; B41J 2/17553; B41J 2/1752; B41J 2/17523; B41J 2002/17516; B41J 2/175; B41J 2/17503; B41J 29/13; B41J 2/17509
USPC ..... 347/7, 84, 85, 86
See application file for complete search history.

(56) References Cited

U.S. PATENT DOCUMENTS

2015/0070447 A1* 3/2015 Nose ..... B41J 2/17513 347/86

FOREIGN PATENT DOCUMENTS

| | | |
|---|---|---|
| JP | 2008-200971 A | 9/2008 |
| JP | 2013-188983 A | 9/2013 |
| JP | 2014-083758 A | 5/2014 |

* cited by examiner

*Primary Examiner* — Jannelle M Lebron

(57) ABSTRACT

An ink cartridge has an ink pack that holds ink and a case that holds the ink pack. The case has a case body forming an ink pack storage space R, and a cover that is removably attached to the case body. An ink supply opening is formed in the front wall of the case body, and a body-side pedestal protruding from the interior of the case body toward the cover inside the case is formed at the opposite end as the ink supply opening. When the cover is attached to the case with an ink pack inside, the back end part of the ink pack is held between a cover-side pedestal protruding from the interior of the cover and the body-side pedestal. The back side of the body-side pedestal forms an exterior recess on the case that can be used as a fingerhold.

11 Claims, 7 Drawing Sheets

INK CARTRIDGE AND PRINTER

BACKGROUND

1. Technical Field

The present disclosure relates to an ink cartridge having an ink pack that stores ink and a case holding the ink pack, and to a printer.

2. Related Art

Ink cartridges that hold ink used for printing, for example, commonly have a flexible ink pack housed inside a box-like case. JP-A-2008-200971 describes this type of ink cartridge.

High-speed printers such as inkjet line printers consume a large amount of ink and therefore use large ink cartridges accommodating high capacity ink packs. However, large ink cartridges are more difficult to handle and use than small, low capacity ink cartridges. Difficult handling increases the likelihood of the ink cartridge being accidentally dropped, and the force of impact upon contact when dropped is great when the ink cartridge is large. As a result, the ink cartridge case may be damaged and ink may leak from the ink pack.

SUMMARY

According to some embodiments, some of the difficulties described above are overcome by an ink pack that holds ink, and a case that holds the ink pack. The case includes a first case member with an ink supply opening formed at a first end of the first case member, a second case member removably attachable to the first case member, the first case member and the second case member forming an ink pack storage space therebetween when the second case member is attached to the first case member, the first case member having a first pedestal that protrudes toward the second case member when attached to the second case member, said first pedestal being formed at a second end of the first case member opposite the first end, and the second case member having a second pedestal that protrudes toward the first pedestal when attached to the first case member. The first pedestal and the second pedestal hold the ink pack in the ink pack storage space when the second case member is attached to the first case member.

Thus comprised, when the second case member attaches to the first case member holding the ink pack, the ink pack can be held between the first pedestal of the first case member and the second pedestal of the second case member. The ink pack can therefore be held stationary inside the case, and the orientation and position of the ink pack can be kept stable. Thus comprised, there is little chance of the ink pack moving inside the case and hitting the case, the second case member separating from the first case member, and the case being damaged if the ink cartridge is dropped. There is also little chance of the ink pack and ink supply opening disconnecting or the ink pack breaking. The impact resistance of the ink cartridge can therefore be increased and there is little chance of ink leaking.

Some embodiments include the ink cartridge also having a fingerhold formed at the second end of the first case member, the fingerhold being a recess disposed on an outer surface of the first case member and formed by the back side of the first pedestal.

By thus using the shape (the pedestals projecting into the case) that holds the ink pack in a fixed location to form a fingerhold (recess) on the back, a structure for securing the ink pack and forming a fingerhold can both be formed by a simple shape. The shape of the case is therefore simple, and reducing the size of the ink pack storage space can be avoided. Furthermore, by disposing the fingerhold on the opposite side as the ink supply opening, the ink cartridge can be easily installed and removed.

Some embodiments include the second case member having a first engaging part protruding toward the first case member; and the first case member having an second engaging part that engages the first engaging part.

By thus engaging the second case member with the first case member, the chance of the second case member separating from the first case member when dropped, for example, can be reduced. Impact resistance can therefore be improved.

Some embodiments include the first case member being box-shaped, having a bottom surface opposite the second case member, a pair of side walls rising toward the second case member from the bottom surface, and a front wall where the ink supply opening is formed intersecting the pair of side walls; and at least part of an outside surface of the pair of side walls facing the outside of the case is roughened.

The ink cartridge can thus be easily held without being dropped by grasping the case from both sides. The ink cartridge is therefore easier to handle and the danger of dropping the ink cartridge can be reduced.

Some embodiments include the case having a reinforced part including an outer wall and an inner wall different from the outer wall; the outer wall being an exterior wall of the case, the inner wall being inside the first case member and disposed alongside the outer wall, and a connector part joining the inner wall to the outer wall.

By providing the case with double walls in part, impact resistance can be improved.

In some embodiments, a printer having a cartridge loading unit to which an ink cartridge according to the present invention installs; a printhead; and an ink path connecting the cartridge loading unit and the printhead. The ink cartridge preferably installs to the cartridge loading unit from the first end of the first case member where the ink supply opening is formed.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of an ink cartridge and printer according to the present invention are described below with reference to the accompanying figures. The following embodiments describe the invention applied to an inkjet printer and to an ink cartridge used in the inkjet printer, but the invention can obviously also be applied to cartridges that hold fluids other than ink.

Inkjet Printer

Figure 1:
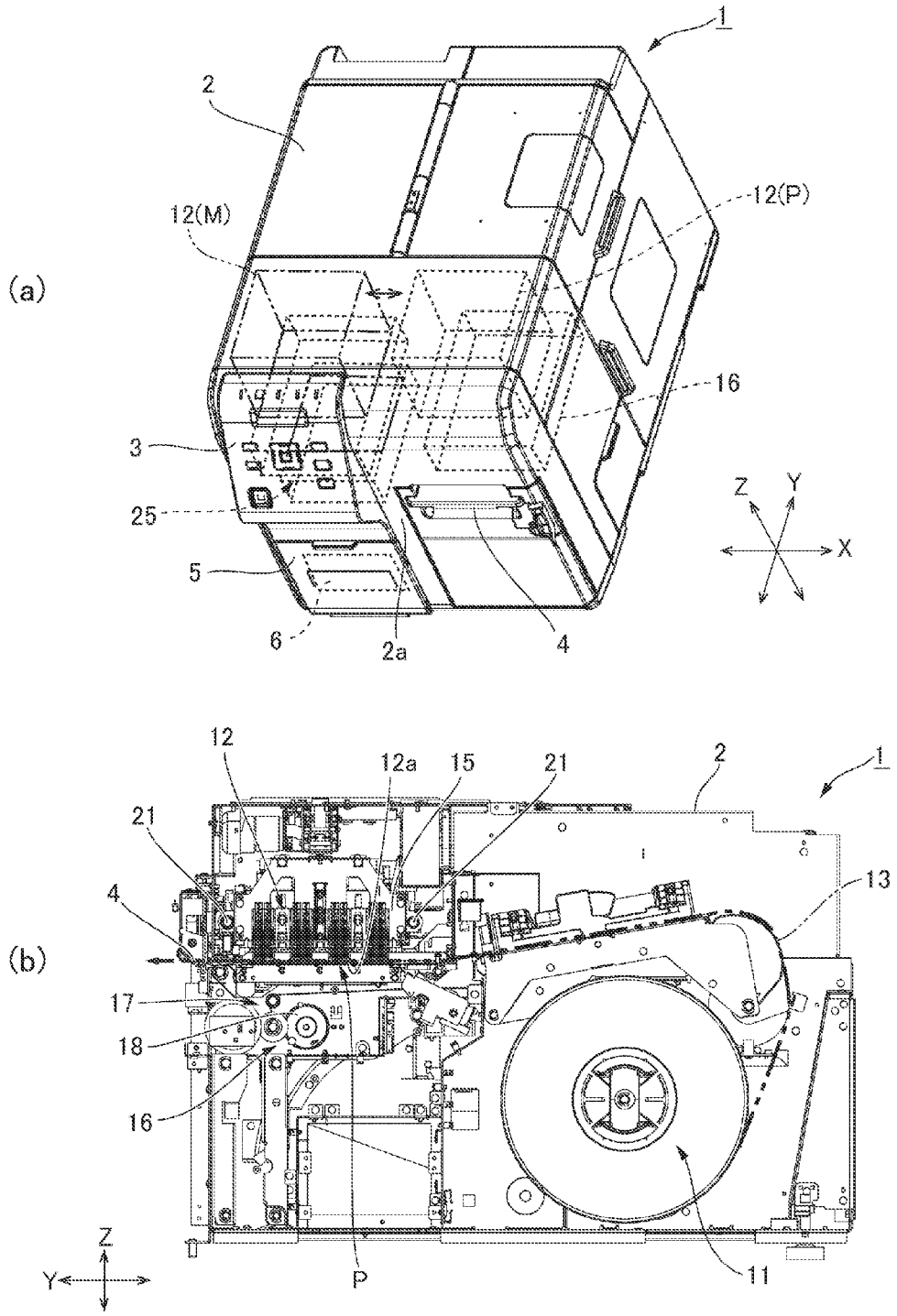
FIG. 1 is an external oblique view and a section view of an inkjet printer that uses an ink cartridge according to the invention.
Figure 2:
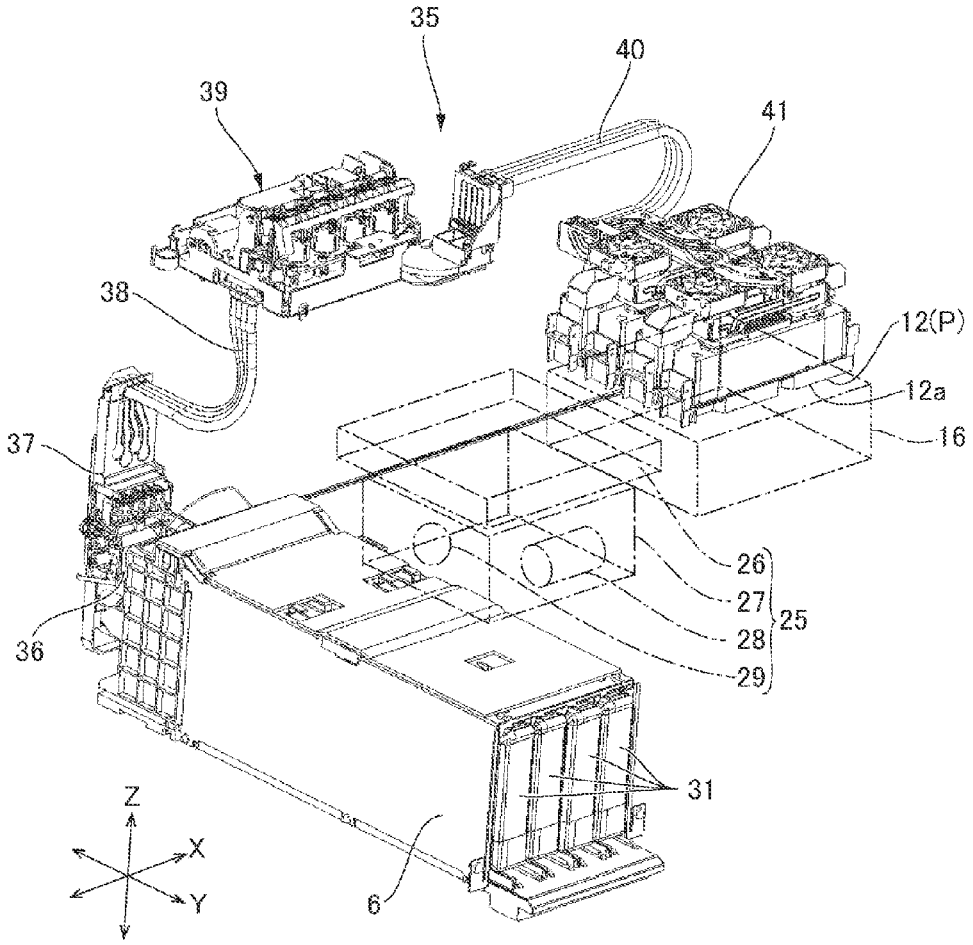
FIG. 2 illustrates the ink path of the inkjet printer shown in FIG. 1.

A preferred embodiment of an inkjet printer that prints with an ink cartridge according to the invention is described first with reference to FIG. 1, which shows two views; a first view (a) and a second view (b). In FIG. 1, view (a) is an external oblique view of the inkjet printer 1, and view (b) is a section view illustrating the inside of the printer 1. FIG. 2 illustrates an ink supply system of the inkjet printer 1 shown in FIG. 1.

As shown in FIG. 1, view (a), the inkjet printer 1 has a printer cabinet 2 that is basically box-shaped and is long from front to back. An operating panel 3 is disposed toward the top on one side of the front 2*a* of the printer cabinet 2, and a paper exit 4 is formed on the other side of the front 2*a*. An access cover 5 is disposed below the operating panel 3. The access cover 5 opens and closes to a cartridge loading compartment 6 disposed inside the printer cabinet 2. The cartridge loading compartment 6 is part of a cartridge loading unit 36 shown in FIG. 2.

Note that the invention is described below with reference to three mutually perpendicular axes, a transverse axis X, a longitudinal axis Y, and a vertical axis Z, as illustrated in view (a).

As shown in FIG. 1, view (b), a roll paper compartment 11 for holding a paper roll is formed inside, and toward the bottom of, the printer cabinet 2 toward its back/rear. A paper conveyance path 13 is formed inside the printer cabinet 2 from the roll paper compartment 11 to the paper exit 4, and passing a printing position P (labeled 12(P) in view (a) to show a phantom box representing a printhead over the printing position). The paper conveyance path 13 extends at an upward angle from the roll paper compartment 11 toward the back along the longitudinal axis Y, and then curves toward the front along the longitudinal axis Y and continues forward to the paper exit 4.

A printhead 12 is disposed toward the top near the front of the printer cabinet 2. The printhead 12 is an inkjet head, and is mounted on a carriage 15 with a nozzle face 12*a* facing downward toward the paper conveyance path 13.

A platen unit 16 is disposed below the printhead 12 at a specific gap from the nozzle face 12*a*. As more clearly shown in view (a), the printing position 12(P) is defined by the platen unit 16.

A conveyance mechanism 17 that conveys continuous recording paper (i.e. recording medium) delivered from the paper roll is disposed to the platen unit 16. A paper feed motor 18 is provided as a drive source of the conveyance mechanism 17.

A pair of carriage guide rails 21 are disposed parallel to the transverse axis X with the carriage 15 therebetween on the longitudinal axis Y. The carriage 15 is supported movably on the transverse axis X by the pair of carriage guide rails 21.

By moving the carriage 15 on the transverse axis X, the printhead 12 may be moved between the printing position P (i.e. 12(P) in view (a)) and a maintenance position 12(M) (shown in view (a)) outside the paper conveyance path 13 on the transverse axis X. With reference to view (a), a head maintenance unit 25 is disposed at maintenance position 12(M). As shown in FIG. 2, the head maintenance unit 25 includes a head cap 26 that is opposite the nozzle face 12*a* of the printhead 12 when at the maintenance position, and a cap moving mechanism 27 that moves the head cap 26 up and down between a capping position covering the nozzle face 12*a*, and an open head position separated from the nozzle face 12*a*. A lift motor 28 is provided as a drive source for the cap moving mechanism 27. The head maintenance unit 25 also has a suction pump 29 that suctions ink from the printhead 12 through the head cap 26.

Ink Supply System

As shown in FIG. 2, the ink supply system includes ink cartridges 31 installed in the cartridge loading compartment 6, and an ink path 35 connecting the ink cartridges 31 to the printhead 12. The ink path 35 includes from the upstream side to the downstream side in the direction of the ink supply from the ink cartridges 31 to the printhead 12: a cartridge loading unit 36, a (non-flexible) flat channel 37, a first flexible channel 38, a diaphragm pump 39, a second flexible channel 40, and a subtank 41. Four ink cartridges 31 respectively supplying black ink, cyan ink, magenta ink, and yellow ink are loaded in the cartridge loading compartment 6 in this example. Therefore, ink path 35 preferably has four ink channels for respectively supplying the black ink, cyan ink, magenta ink, and yellow ink to the printhead 12.

Figure 3:
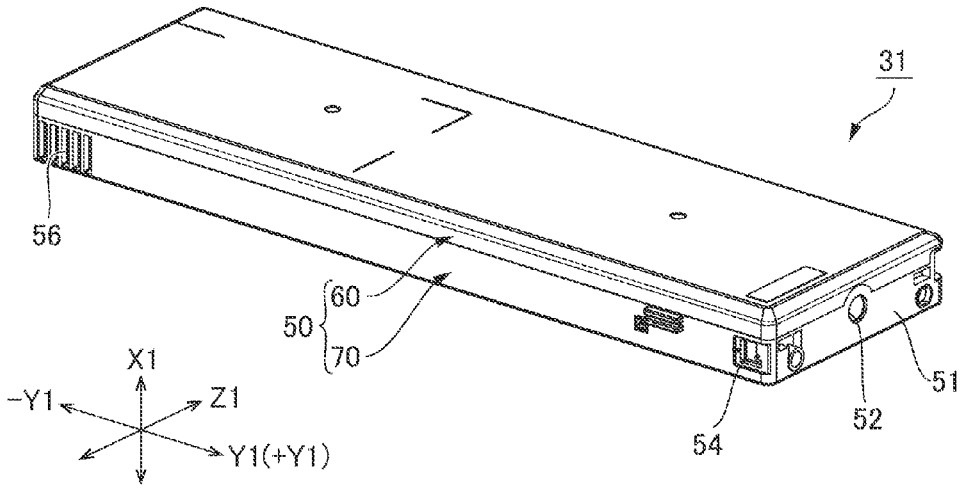
FIG. 3 is an oblique view of an ink cartridge, including a case comprised of a cover and case body, according to the invention.

The cartridge loading unit 36 has ink needles that connect to ink supply openings 52 of the ink cartridges 31, as shown in FIG. 3. The diaphragm pump 39 suctions ink from the ink cartridges 31 and supplies the ink to the subtank 41. The subtank 41 has a pressure adjusting mechanism (not shown in the figure) and supplies ink to the printhead 12 with a specific ink pressure.

Ink Cartridge

Figure 4:
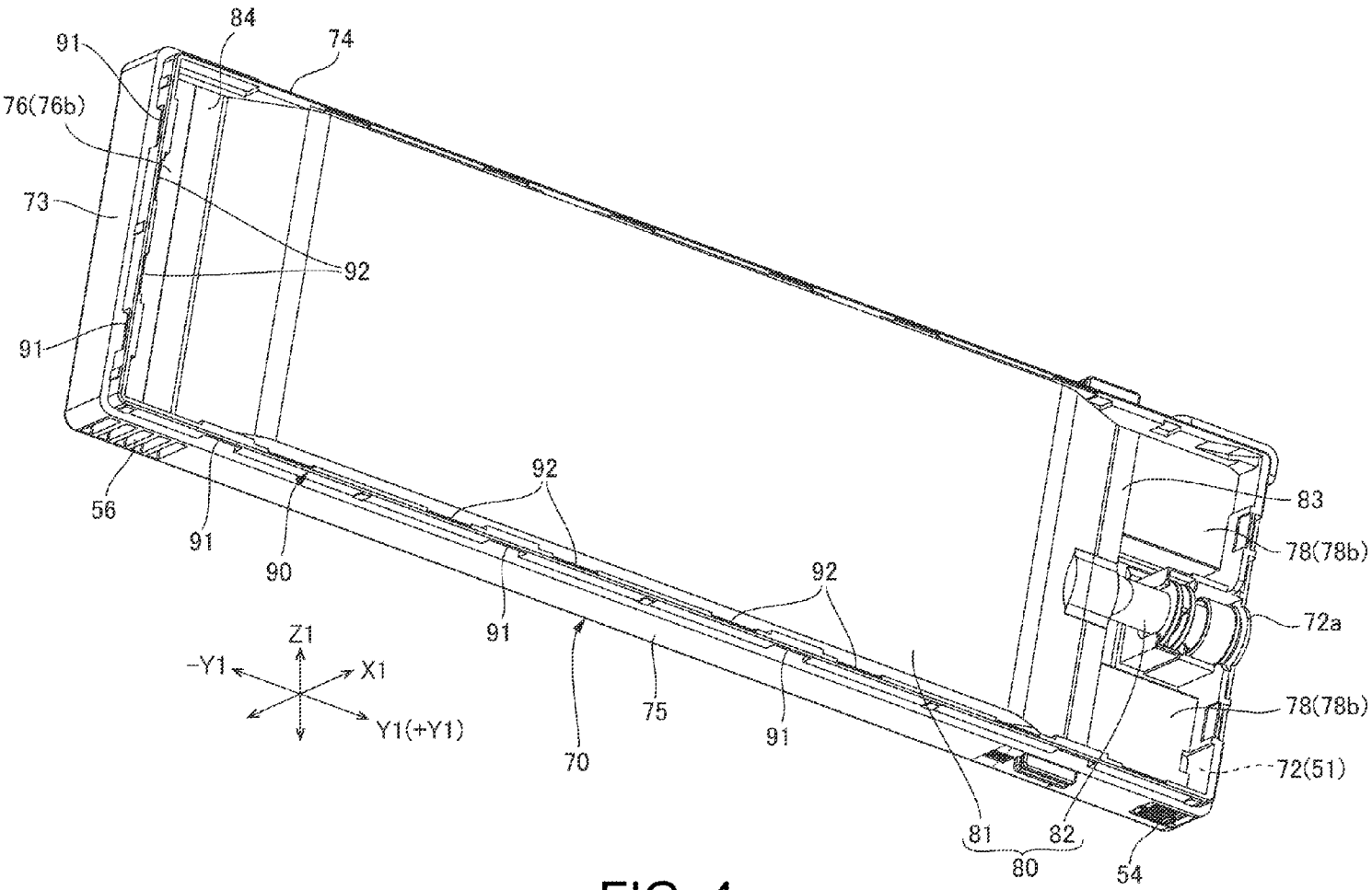
FIG. 4 is an oblique view showing an ink pack housed in the case body of the ink cartridge shown in FIG. 3.
Figure 5:
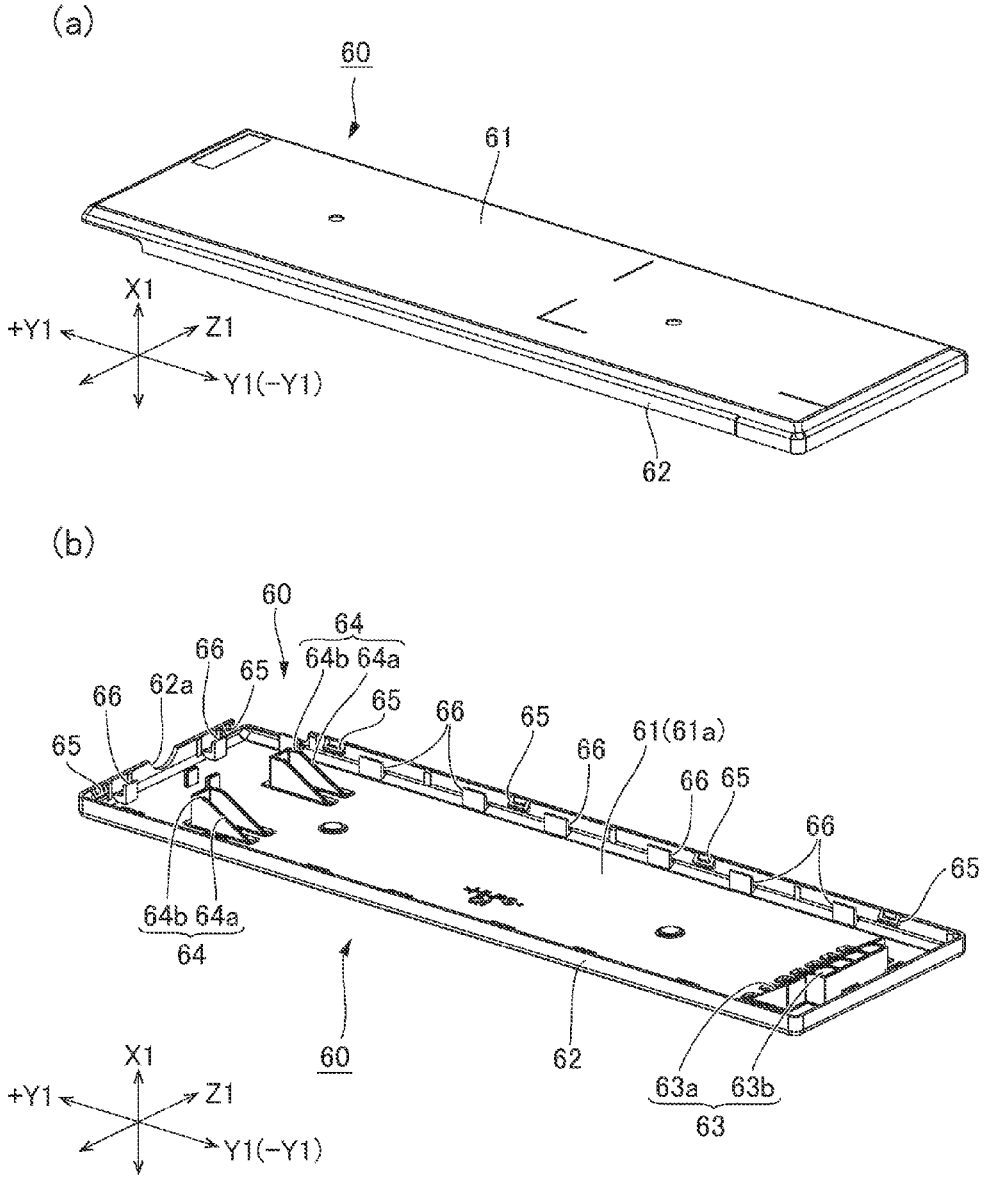
FIG. 5 shows top and bottom oblique views of the cover.
Figure 6:
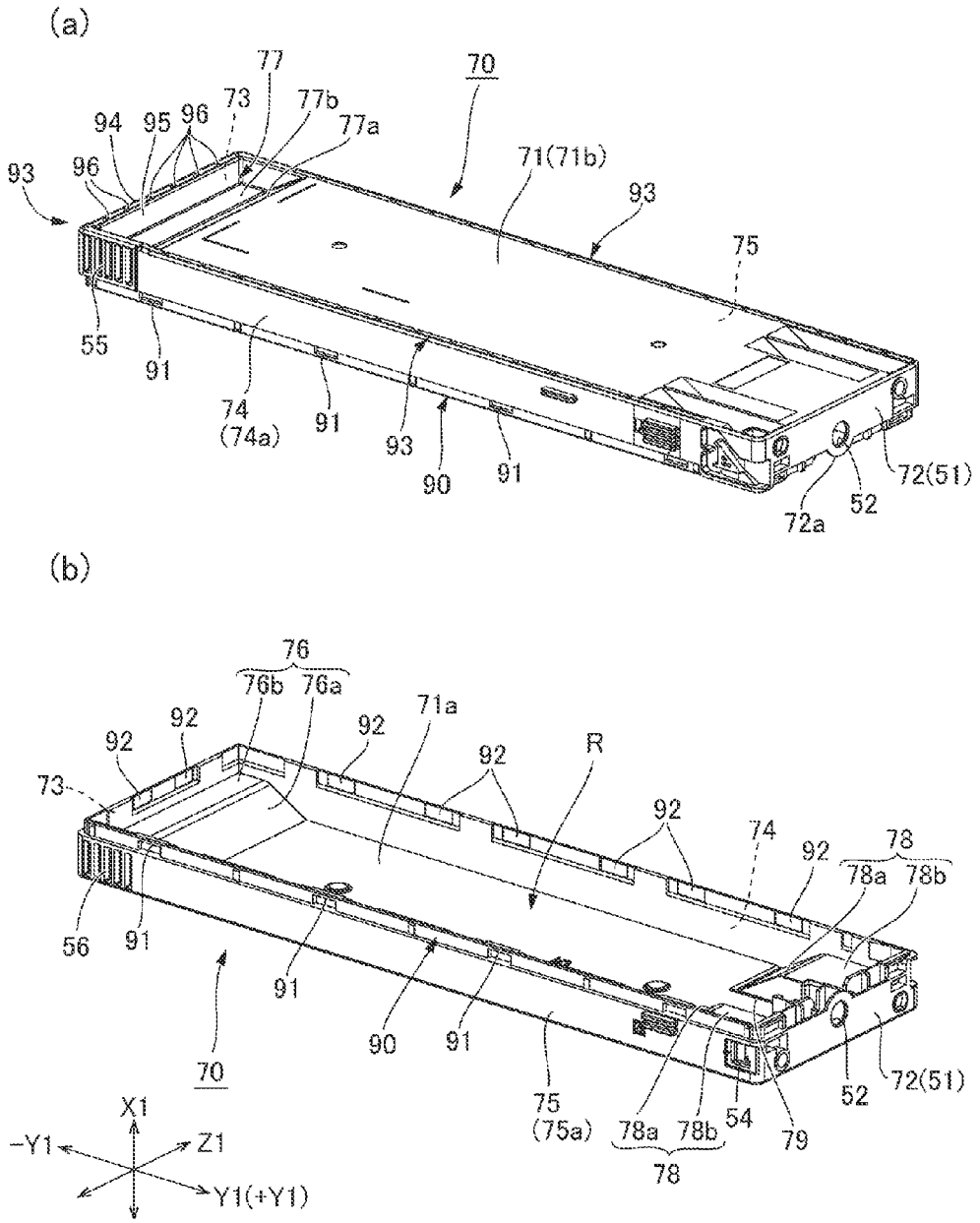
FIG. 6 shows bottom and top oblique views of the case body.

FIG. 3 is an external oblique view of an ink cartridge 31 according to the invention. The ink cartridge 31 has a case 50 comprised of a cover 60 detachably coupled to a case body 70. FIG. 4 is an oblique view showing the ink cartridge 31 with an ink pack 80 housed inside the case (i.e. within case body 70). FIG. 5 is an oblique view of the cover 60, and FIG. 6 is an oblique view of the case body 70. In FIG. 5, view (a) is an oblique view of the cover 60 as viewed from outside the case (e.g. a topside (or exterior) view of the cover), and view (b) is an oblique view of the cover 60 as viewed from inside the case (e.g. an underside (or interior) of the cover 60). In FIG. 6, view (a) is an oblique view of the case body 70 as viewed from outside the case (e.g. an underside (or exterior) view of the case body), and view (b) is an oblique view of the case body 70 as viewed from inside the case (e.g. a topside (or interior) view of the case body).

The ink cartridge is described below using three mutually perpendicular axes, a transverse axis X1 along the width of the case, a longitudinal axis Y1 along the length of the case, and a vertical axis Z1 along the height of the case. The side of the case at one end on the longitudinal axis Y1 is the case front +Y1, and the opposite side of the case at the other end on the longitudinal axis Y1 is the case back −Y1.

As shown in FIG. 3 to FIG. 6, the ink cartridge 31 has a rectangular case 50 that is long on the longitudinal axis Y1, and a flexible ink pack 80 that is held inside the case 50.

The ink cartridge 31 can be removably installed to the cartridge loading compartment 6 of the inkjet printer 1. As shown in FIG. 3, an ink supply opening 52 is formed in the front end 51 (the end on the case front +Y1 side) of the case 50. When the ink cartridge 31 is installed to the cartridge loading compartment 6, it is inserted with the front end 51 first into the cartridge loading compartment 6.

As a result, a corresponding ink needle is inserted into the ink supply opening 52, and connects to the ink pack 80 inside the case 50.

Ink Pack

As shown in FIG. 4, the ink pack 80 has a flexible ink sack 81 and an ink supply unit 82 fixed to the front end of the ink sack 81. The ink sack 81 is long on the longitudinal axis Y1. The ink sack 81 is made by welding four pieces of flexible film into a gazette bag configuration. More specifically, the ink sack 81 has two pieces of film (top and bottom films) on one side and the other side of the transverse axis X1, one piece of film (side film) welded to one side of the top and bottom films, and another piece of film (side film) welded to the other side of the top and bottom films. The side films are folded into a V shape with the two top and bottom films therebetween at the opposite ends of the ink sack 81 on the longitudinal axis Y1, and are bonded by film welds 83, 84. The ink supply unit 82 is attached to one end (the case front +Y1 end) of the ink sack 81 in the middle of the one film weld 83.

Case

As shown in FIG. 3, the case 50 includes a cover 60 (second case member) and a case body 70 (first case member). The cover 60 forms one side of the case 50 on the transverse axis X1.

The cover 60 is removably attached to the case body 70, and attaching the cover 60 to the case body 70 completes the case 50. Removing the cover 60 from the case body 70 exposes the ink pack 80 as shown in FIG. 4. The ink pack 80 can therefore be replaced.

As shown in FIG. 5, the cover 60 has a rectangular cover plate 61 with side walls 62 that extend from the four sides of the cover plate 61 toward the case body 70. The side walls 62 are formed around the entire perimeter of the cover plate 61. As shown in view (b), a first cover pedestal 63 that protrudes toward the case body 70 is formed on the inside surface 61*a* of the cover plate 61 (the surface facing the case body 70). This first cover pedestal 63 is formed at the case back −Y1 end of the cover plate 61. The first cover pedestal 63 has an inclined face 63*a* that descends toward the case front +Y1, and a back end 63*b* that rises to a constant height at the case back −Y1 end of the inclined face 63*a*. The inclined face 63*a* and back end 63*b* are formed by ribs that rise from the cover plate 61.

A curved notch 62*a* is formed in the side wall 62 rising at the case front +Y1 end of the cover plate 61. The notch 62*a* is formed at a position corresponding to the location of the ink supply opening 52 described above. Second cover pedestals 64 are formed on the inside surface 61*a* of the cover plate 61 near the notch 62*a*. The second cover pedestals 64 are formed at two locations on the transverse axis X1. When the cover 60 is attached to the case body 70, the ink supply unit 82 of the ink pack 80 in the case body 70 is between these two second cover pedestals 64 on the transverse axis X1. The second cover pedestals 64 each have an inclined face 64*a* that descends toward the case back −Y1, and a front end 64*b* that rises to a constant height at the case front +Y1 end of the inclined face 64*a*. The inclined face 64*a* and back end 64*b* are formed by ribs that rise from the cover plate 61.

Outside tabs 65 and inside tabs 66 are formed at offset positions along the inside of the side walls 62. The outside tabs 65 are formed with a specific interval therebetween, and the inside tabs 66 are formed between the outside tabs 65. The outside tabs 65 protrude to the inside from the inside surface of the side walls 62, and the inside tabs 66 protrude from the cover plate 61 at a position separated slightly to the inside from the side walls 62. The outside tabs 65 increase in size as they protrude to the inside (toward the inside tabs 66).

As shown in FIG. 6, the case body 70 is the part of the case 50 without the cover 60, and has a bottom 71 opposite the cover 60, and a front wall 72, back wall 73, and side walls 74, 75 rising from the outside edge of the bottom 71 toward the cover 60. The front wall 72 rises from the case front +Y1 edge of the bottom 71, and forms the front end 51 of the case 50. The ink supply opening 52 is a through-hole formed in the center of the front wall 72 on the vertical axis Z1. A curved protrusion 72*a* that surrounds the ink supply opening 52 is formed in the front wall 72 in the middle on the transverse axis X1. The notch 62*a* in the cover 60 mates with this protrusion 72*a*.

The back wall 73 of the case body 70 forms the back end of the case 50 opposite the front wall 72 on the longitudinal axis Y1. The one side wall 74 connects the front wall 72 and back wall 73 at one end on the transverse axis X1, and the other side wall 75 connects the front wall 72 and back wall 73 at the other end on the transverse axis X1. The case body 70 forms a recess surrounded by the bottom 71, front wall 72, back wall 73, and side walls 74, 75, and this recess forms an ink pack storage space R where the ink pack 80 is stored.

A recess is formed in the outside surface 74*a* of the side wall 74 near the corner with the front wall 72, and a terminal block 54 is disposed in this recess. A circuit board (FIG. 4) is connected to the terminal block 54. When the ink cartridge 31 is installed in the cartridge loading compartment 6 of the inkjet printer 1, the terminals on the circuit board affixed to the terminal block 54 come in contact (and connect) with terminals of the cartridge loading compartment 6 on the inkjet printer 1 side. Once connected, the control unit of the inkjet printer 1 can control operations using information stored on the circuit board disposed to the terminal block 54.

As shown in FIG. 6, view (b), a first body-side pedestal 76 (first pedestal) is formed protruding toward the cover 60 from the inside surface 71*a* of the bottom 71 (the surface of the side facing the cover 60). The first body-side pedestal 76 is formed at the case back −Y1 end of the bottom 71. The first body-side pedestal 76 has an inclined face 76*a* that descends toward the case front +Y1, and a back end 76*b* that rises to a constant height at the case back −Y1 end of the inclined face 76*a*.

As shown in FIG. 6, view (a), a fingerhold 77 is formed on the outside surface 71*b* of the bottom 71 (the surface on the opposite side as the cover 60). The fingerhold 77 is located at the opposite end (the case back −Y1 end) of the outside surface 71*b* as the ink supply opening 52. The fingerhold 77 is a recess toward the cover 60 when seen from outside the case body 70. The shape of this recess (fingerhold 77) corresponds to the back side of the first body-side pedestal 76 formed on the inside of the case body 70. More specifically, the fingerhold 77 has an inclined part 77*a* that increases in depth from the outside surface 71*b* toward the case back −Y1, and a back end 77*b* having a constant depth at the case back −Y1 side of the inclined part 77*a*. The inclined part 77*a* is the back surface of the inclined face 76*a*, and the back end 77*b* is the back surface of the back end 76*b*.

As shown in FIG. 6, view (b), second body-side pedestals 78 are formed on the inside surface 71*a* of the bottom 71 at the end near the ink supply opening 52 (on the case front +Y1 side). The body-side pedestals 78 are formed at two locations on the transverse axis X1. The space between the two second body-side pedestals 78 is recessed, and this recess forms a holder 79 where the ink supply unit 82 of the ink pack 80 is placed. The second body-side pedestals 78 each have an inclined face 78*a* that descends toward the case back −Y1, and a front end 78*b* that rises to a constant height at the case front +Y1 end of the inclined face 78*a*.

As shown in FIG. 4, when the ink pack 80 is placed in the ink pack storage space R of the case body 70, the film weld 84 at the back of the ink pack 80 rests on the back end 76*b* of the first body-side pedestal 76, and the film weld 83 at the front end of the ink pack 80 rests on the front end 78*b* of the second body-side pedestals 78. When the cover 60 is attached to the case body 70, the film weld 84 at the back end of the ink pack 80 is held between the back end 63*b* of the first cover pedestal 63 of the cover and the back end 76*b* of the first body-side pedestal 76 of the case body, and the film weld 83 at the front end of the ink pack 80 is held between the front ends 64*b* of the second cover pedestals 64 of the cover and the front end 78*b* of the second body-side pedestals 78 of the case body.

As shown in FIG. 6, view (b), an engaged part (or engaging part) that the outside tabs 65 and inside tabs 66 of the cover 60 engage with is formed along the top edge 90 of the front wall 72, back wall 73, and side walls 74, 75 of the case body 70. More specifically, outside engaged parts (or engaging parts) 91 that engage with the outside tabs 65 of the cover 60 are formed on the outside surface side of the top edge of the front wall 72, back wall 73, and side walls 74, 75 of the case body 70. The outside engaged parts 91 are recesses formed at positions corresponding to the outside tabs 65. Inside engaged parts (or engaging parts) 92 that engage with the inside tabs 66 of the cover 60 are formed on the inside surface side of the top edge of the front wall 72, back wall 73, and side walls 74, 75 of the case body 70. The inside engaged parts 92 are recesses formed at positions corresponding to the inside tabs 66. The outside engaged parts 91 and inside engaged parts 92 are formed alternately around the front wall 72, back wall 73, and side walls 74, 75 appropriately to (i.e. corresponding to) the positions of the outside tabs 65 and inside tabs 66.

When the cover 60 is attached to the case body 70, the outside tabs 65 engage the outside engaged parts 91, and the inside tabs 66 engage the inside engaged parts 92. As a result, the outside tabs 65 and inside tabs 66 engage the inside and outside of the front wall 72, back wall 73, and side walls 74, 75 at the top edge 90. This engagement structure makes it more difficult for the cover 60 to separate from the case body 70.

As shown in FIG. 6, view (a), an anti-slip part 55 is disposed to the outside surface 74*a* of the side wall 74 of the case body 70 near the corner with the back wall 73 (the corner at the case back −Y1). The anti-slip part 55 is a rough area formed on the outside surface 74*a*. In this example, multiple narrow grooves extending on the transverse axis X1 form the anti-slip part 55. As shown in FIG. 6, view (b), an anti-slip part 56 is also disposed to the outside surface 75*a* of the side wall 75 near the corner with the back wall 73 (the corner at the case back −Y1). Except for its location, this anti-slip part 56 is identical to the other anti-slip part 55. The anti-slip parts 55, 56 are formed at the back of the case 50 at one side and the other side on the vertical axis Z1.

The back wall 73 and side walls 74, 75 of the case body 70 have a reinforced part 93 formed at least toward the bottom near the bottom 71. The reinforced part 93 includes an outside wall 94 facing the outside, an inside wall 95 disposed on the inside with a small gap to the outside wall 94, and connectors 96 joining the outside wall 94 and inside wall 95. For example, as shown in FIG. 6, view (a), the back wall 73 of the case body 70 has the inside wall 95 forming the inside surface of the fingerhold 77, the outside wall 94 forming the outside surface of the case at the back wall 73, and the inside wall 95 and outside wall 94 are disposed with a small space therebetween. The connectors 96 joining the inside wall 95 and the outside wall 94 are disposed at a constant pitch in this space between the walls. A reinforced part 93 with the same structure is also disposed to the side walls 74, 75.

As described above, the ink cartridge 31 according to this embodiment has an ink pack 80 that holds ink, and a case 50 that holds the ink pack 80, and the case 50 includes a case body 70 forming a ink pack storage space R, and a cover 60 that removably attaches to the case body 70. An ink supply opening 52 is formed in the case body 70 at the end on the case front +Y1 side (in the front wall 72), and a first body-side pedestal 76 that protrudes toward the cover 60 inside the case 50 at the opposite end as the ink supply opening 52 (on the case back −Y1 side). A first cover pedestal 63 that protrudes toward the case body 70 is formed in the cover 60 at a position opposite the first body-side pedestal 76.

With the construction described in this example, when the cover 60 is attached to the case body 70 holding the ink pack 80, the back end part of the ink pack 80 is held between the first cover pedestal 63 and the first body-side pedestal 76. The ink pack 80 can therefore be held stationary inside the case 50, and the orientation and position of the ink pack 80 can be kept stable. This construction minimizes the chance of the cover 60 coming off and parts of the case 50 being damaged if the ink pack 80 moves inside the case 50 and impacts the case 50 when the ink cartridge is dropped. There is also little chance of the ink pack 80 and ink supply opening 52 disconnecting or the ink pack 80 breaking. The impact resistance of the ink cartridge 31 is therefore high and there is little chance of ink leaking.

Furthermore, in this example the back side of the first body-side pedestal 76, which is the structure fixing the ink pack 80 in the case 50, is a recess utilizing the shape of the first body-side pedestal 76, and can be used as a fingerhold 77. Thus comprised, the structure that fixes the ink pack 80 and the fingerhold 77 can be formed with a simple shape. Compared with a configuration in which these are separate constructions, reducing the size of the ink pack storage space R can also be avoided. Furthermore, because the fingerhold 77 is disposed to the opposite end (the case back −Y1 end) as the ink supply opening 52, the ink cartridge 31 can be easily installed and removed, and is easier to handle.

In this example, the cover 60 and case body 70 are engaged by outside tabs 65 and inside tabs 66 formed on the edge of the cover 60 engaging the top edge 90 around the opening to the case body 70 from both sides. This construction reduces the chance of the cover 60 separating from the case body 70 when dropped, for example, and provides the ink cartridge 31 with high impact resistance.

An anti-slip surface is also formed on the surfaces of the pair of opposing side walls 74, 75 on the outside of the case (outside surfaces 74*a*, 75*a*). The case 50 can therefore be reliably gripped when the user holds the case 50 from both sides on the vertical axis Z1, and the ink cartridge 31 is easy to handle. This anti-slip treatment may be applied to the entire surface or only part of the outside surfaces 74*a*, 75*a*. Because the anti-slip parts 55, 56 are disposed to the end at the case back −Y1 in this example, the ink cartridge 31 can be held at the back end of the case 50 and easily installed and removed. Anti-slip parts may also be disposed to the cover plate 61 of the cover 60 and the bottom 71 of the case body 70.

This embodiment of the invention also has a double-walled reinforced part on the back wall 73 and side walls 74, 75 of the case body 70. There is therefore little chance of damage when dropped, and as a result little chance of the cover 60 separating and ink leaking. Impact resistance when dropped, for example, is therefore high.

Other Embodiments

Figure 7:
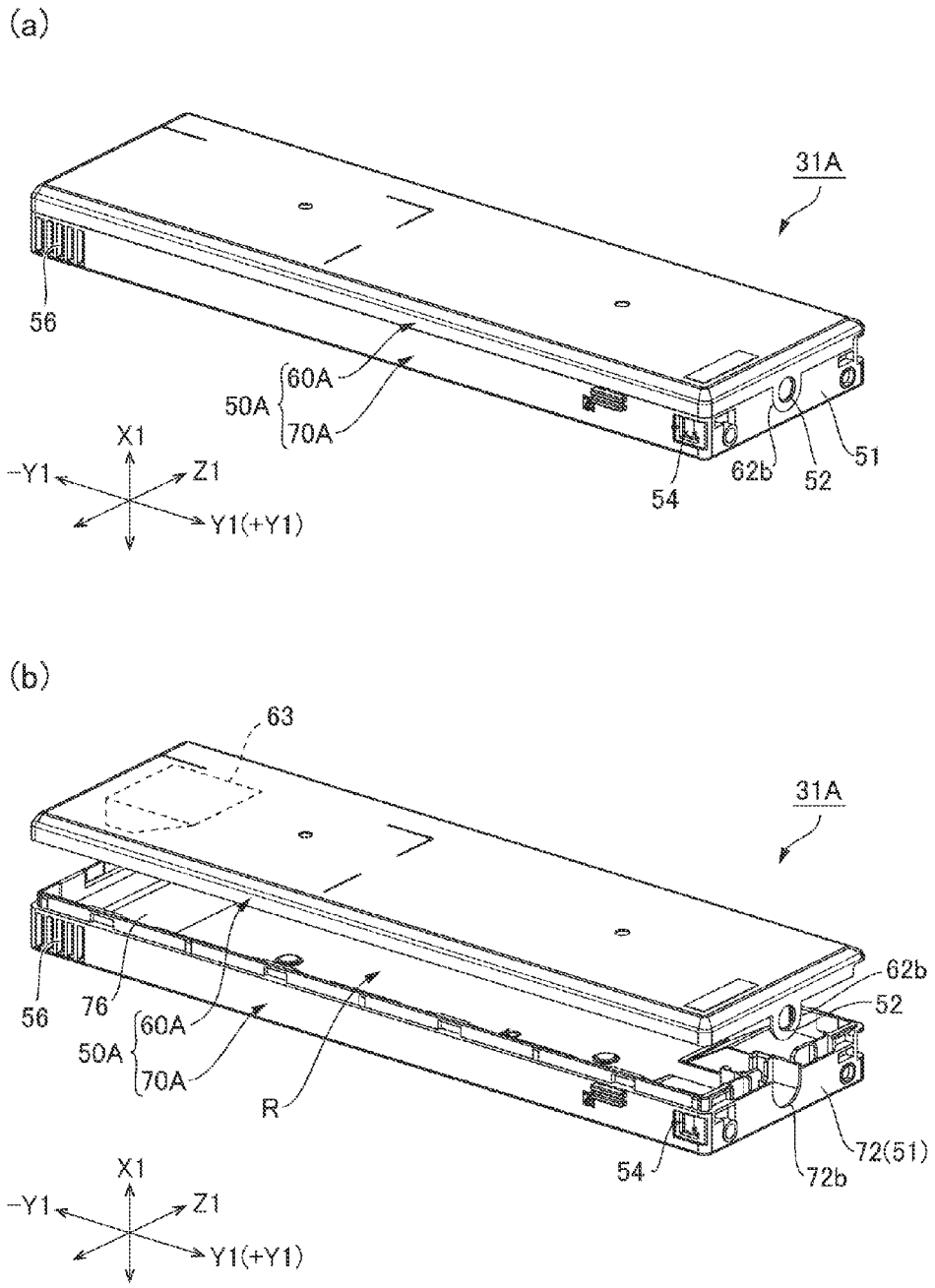
FIG. 7 shows another example of an ink cartridge according to the invention.

FIG. 7 is an external oblique view of an ink cartridge according to another embodiment of the invention, FIG. 7, view (a) being an oblique view of the ink cartridge with the cover lowered onto the case body, and FIG. 7, view (b) being an oblique view of the ink cartridge with the cover lifted from the case body. Note that only different parts have different reference numerals, and further description of like parts is omitted. The ink cartridge 31A in the embodiment shown in FIG. 7 has a case 50A that holds the ink pack 80. This case 50A has a cover 60A (first case) and a case body 70A (second case). The ink supply opening 52 is formed in the front end 51 of the case 50A.

In the example shown in FIG. 7, the ink supply opening 52 is formed in the cover 60A. A curved protrusion 62*b* that surrounds the ink supply opening 52 is formed in the side wall 62 of the cover 60A at the case front +Y1 end. A curved recess 72*b* is formed in the front wall 72 at the end of the case body 70A on the longitudinal axis Y1. The protrusion 62*b* of the cover 60A fits into the curved recess 72*b*.

Except that the protrusion 62*b* and ink supply opening 52 are formed in the cover 60A, and a curved recess 72*b* that mates with the protrusion 62*b* is formed in the case body 70A, the case 50A of the ink cartridge 31A shown in FIG. 7 is identical to the case 50 described in the previous embodiment. More specifically, in the embodiment shown in FIG. 7, the cover 60A is the first case member and the case body 70A is the second case member of the invention described in the following claims. The ink cartridge 31A in FIG. 7 can therefore hold the back end part of the ink pack 80 between the first cover pedestal 63 of the cover 60A and the first body-side pedestal 76 of the case body 70A. The ink cartridge 31A therefore has the same effect as described above.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. An ink cartridge comprising:

an ink pack that holds ink, the ink pack including an ink supply unit communicable to an ink supply opening of the ink cartridge for dispensing ink; and a case that holds the ink pack, the case including:

a first case member with the ink supply opening formed at a first end of the first case member and a holder that holds the ink supply unit in communication with the ink supply opening, a second case member removably attachable to the first case member, the first case member and the second case member forming an ink pack storage space therebetween when the second case member is attached to the first case member, the first case member having a first pedestal that protrudes toward the second case member when attached to the second case member, said first pedestal being formed at a second end of the first case member opposite the first end, and the second case member having a second pedestal that protrudes toward the first pedestal when attached to the first case member;

the first pedestal and the second pedestal holding the ink pack in the ink pack storage space when the second case member is attached to the first case member:

wherein the second case member further includes:

a cover plate to cover an opening of the first case member:

second side walls along edges of the cover plate;

inner tabs and outer tabs formed in a staggered arrangement along at least part of the second side walls the inner tabs protruding from the cover plate at positions offset from the second side walls toward the interior of the cover plate, the outer tabs protruding from the second side walls toward the interior of the cover plate.

2. The ink cartridge described in claim 1, further comprising:

a fingerhold formed at the second end of the first case member, the fingerhold being a recess disposed on an outer surface of the first case member and formed by the back side of the first pedestal.

3. The ink cartridge described in claim 1, wherein:

the second case member has a first engaging part protruding toward the first case member; and the first case member has a second engaging part that engages the first engaging part.

4. The ink cartridge described in claim 1, wherein:

the first case member has a reinforced part including an outer wall and an inner wall different from the outer wall;

the outer wall being an exterior wall of the case;

the inner wall being inside the first case member and disposed alongside the outer wall, and a connector part joining the inner wall to the outer wall.

5. The ink cartridge described in claim 1, wherein;

the ink pack has a first film, a second film, and a side film, the side film being welded to one side of the first film and the second film, the first film being configured to contact with the first case member, and the second film being configured to contact with the second case member.

6. The ink cartridge descried in claim 1, wherein:

the ink supply opening is formed on a first front wall of the first case member, a first upper edge of the first front wall having a shape at least partially following a contour of the ink supply opening; and the second case member has a second front wall having a second upper edge inversely following the contour of the first upper edge of the first front wall.

7. The ink cartridge descried in claim 1, wherein the outer tabs increase in size as they extend toward the interior of the cover plate.

8. The ink cartridge described in claim 1, wherein the first case member further includes:

first sides walls that mate with the second side walls to cover the opening of the first case member with the cover plate, the first side walls having inside recesses and outside recesses formed in a staggered arrangement along a top edge of the first side walls, the inside recesses being on an interior side of the first side walls facing the interior of the first case member, the outside recesses being on an exterior side of the first side walls facing the exterior of the first case member, the inside recesses being positioned to correspond to inner tabs of the second case member, the outside recesses being positioned to correspond to outer tabs of the second case member, and inner tabs engaging the inside recesses and the outer tabs engaging the outside recesses when the second case member is attached to the first case member.

9. The ink cartridge described in claim 1, wherein:

the first case member is box-shaped, having a bottom surface opposite the second case member, a pair of side walls rising toward the second case member from the bottom surface, and a front wall where the ink supply opening is formed intersecting the pair of side walls; and an outside surface of the pair of side walls facing the outside of the case including an anti-slip part formed proximate to the second end.

10. The ink cartridge described in claim 9, wherein the second case member has no anti-slip part on its exterior surface.

11. A printer comprising:

a cartridge loading unit to which the ink cartridge of claim 1, installs;

a printhead; and an ink path connecting the cartridge loading unit to the printhead;

the ink cartridge installing to the cartridge loading unit from the first end of the first case member where the ink supply opening is formed.

* * * * *